US010894187B2

(12) United States Patent
Foss

(10) Patent No.: US 10,894,187 B2
(45) Date of Patent: Jan. 19, 2021

(54) ERGONOMIC TRAINING PADDLE WITH REDUCED FINGER SLIPPAGE

(71) Applicant: Jonathan G. Foss, Waconia, MN (US)

(72) Inventor: Jonathan G. Foss, Waconia, MN (US)

( * ) Notice: Subject to any disclaimer, the term of this patent is extended or adjusted under 35 U.S.C. 154(b) by 0 days.

(21) Appl. No.: 16/290,667

(22) Filed: Mar. 1, 2019

(65) Prior Publication Data

US 2020/0276477 A1 Sep. 3, 2020

(51) Int. Cl.
*A63B 31/02* (2006.01)

(52) U.S. Cl.
CPC ..... *A63B 31/02* (2013.01); *A63B 2244/20* (2013.01)

(58) Field of Classification Search
CPC ..... A63B 2244/20; A63B 31/02
See application file for complete search history.

(56) References Cited

U.S. PATENT DOCUMENTS

| | | | | | |
|---|---|---|---|---|---|
| 183,045 | A * | 10/1876 | Dunlop | A63B 31/04 441/58 |
| 5,288,254 | A * | 2/1994 | Elson | A63B 31/10 441/56 |
| 5,511,998 | A * | 4/1996 | Johnson | A63B 31/10 441/56 |
| 9,717,953 | B1 * | 8/2017 | Foss | A63B 31/10 |
| D840,487 | S * | 2/2019 | DiLorenzo | D21/807 |
| 2016/0067551 | A1 * | 3/2016 | Tilson | A63B 31/04 482/55 |

* cited by examiner

*Primary Examiner* — S. Joseph Morano
*Assistant Examiner* — Jovon E Hayes
(74) *Attorney, Agent, or Firm* — Mark A. Litman & Associates, P.A.

(57) ABSTRACT

A swim training apparatus for use on a hand of a swimmer in water during a swimming motion, said training aid apparatus comprising: a plate member having a first surface and an opposed second surface and a leading edge and a trailing edge. The first surface has four straight grooves having a bottom and elevated sides along passing from a base of the first surface adjacent the wrist towards a top of the first surface where fingertips extend, wherein height of the elevated sides is at least 1 mm higher than a lowest point of the bottom of the groove.

20 Claims, 4 Drawing Sheets

ERGONOMIC TRAINING PADDLE WITH REDUCED FINGER SLIPPAGE

BACKGROUND OF THE INVENTION

1. Field of the Invention

The present invention relates to the field of athletic training devices, and particularly to devices useful for enhanced stress and hand feel training for swimmers, and training devices with reduced stress and pressure on the swimmers hands.

2. Background of the Art

Athletic training attempts to accentuate and target both memory and strength in specific muscles used in particular sports. Swimming is a sport that is well-regarded with respect to its use of most of the muscles in the human body, and in requiring skilled use, positioning and strength in the use of those muscles.

Particularly with respect to the multiple arm positions and movements used in swimming among the four strokes (backstroke, breaststroke, butterfly and freestyle), any training device must allow the user-controlled muscle stress, hand feel, and freedom of hand movement, avoiding any structural interactions between the device and the body of the swimmers that cause damage or injury.

Fins have long been used, often improperly, putting stress on ankles and knees. Hand paddles have also been used for years, and with the various styles of paddles, it has been difficult to balance appropriate levels of resistance to enhance strength training, hand feel in the water, stability on the swimmer's hands, and absence of abrasive or cutting effects on hands and wrists.

Among the different structures used for hand paddles are the following.

Published US Patent Application Documents No. 20150196807 (Davis) relates to swimming paddles used for strength training in fitness swimming and performance swimming. A swimming paddle comprises an oversized paddle body having top and bottom surfaces, proximal and distal sides, and lateral and medial sides, the paddle body having a hand placement portion for placing a hand thereon. The swimming paddle further comprises a hand securing portion configured to secure a hand to the paddle body. A portion of a side of the paddle body is scalloped (having a wavy pattern). It is asserted that by scaling its unique flow and temperature phenomena in water to that of air, the humpback whale's pectoral fin has inspired biomimicry for various industrial applications, such as the development of large scale scalloped or tubercle-lined blades as shown in FIG. 2*d*

Published US Patent Application Document No. 20150056878 (Watchorn) relates to a hand paddle system comprising a wrist member and a hand member. The wrist member and hand member are intercoupled. The wrist and hand members are configured to releasably couple or receive the scaphoid and metacarpal regions of a user's hand. The hand paddle system is composed and/or configured to be buoyant. The hand paddle system may also include a finger member coupled to the hand member opposite of the wrist member. The system causes an increased water entry resistance when the user improperly orients their arm and/or wrist leading up to and at the catch point and the buoyancy facilitates an early, high elbow catch and pull.

Published US Patent Application Document No. 20080242167 (Bolster) describes an aquatic propulsion device for holding a hand or foot in a desired position, the device comprising a curvilinear support surface and a linking element arranged across the hand or foot joint at a desired angle to secure the joint in the desired position.

Published US Patent Application Document No. 20040009458 (Topolski) describes a swim stroke trainer apparatus and method that includes providing a forearm paddle adapted to be connected to a swimmer's forearm to promote a downward motion of the hand and forearm and a bicep/tricep float adapted to be connected with a swimmer's upper arm to promote an elevated elbow.

U.S. Pat. No. 5,304,080 (Dilger) describes a substantially flat, oval-shaped swim paddle for use on a swimmer's hand having two halves connected by a flexible hinge. The anterior half has ridges defining finger indexes for placement of the swimmer's fingers. The posterior half has a centrally located raised palm portion which, when in use, fits comfortably within the hollow area of the swimmer's palm. Velcro® type fasteners secure the paddle to the swimmer's hand. Texturing on the hand side of the paddle, the finger indexes and the raised palm portion allow the swimmer to more easily control the paddle.

U.S. Pat. No. 5,388,254 (Elson) describes a swimmer's hand paddle comprised of a planar member having a perpendicularly depending fin. The paddle's planar member is bilaterally symmetrical and generally triangular. It has a textured upper surface, a rounded forward apex, a pair of divergent opposing side edges and an inwardly-curved rearward edge. A rearward projection is defined on each side of the planar member between the outer end of the rearward edge and the rearward end of the adjacent side edge. The fin is generally triangular and depends from the planar member's lower surface. Its narrower end is disposed adjacent the planar member's forward apex and its wider end is disposed adjacent the planar member's rearward edge. Opposing ends of a length of resilient tubing pass through a pair of adjacent apertures in planar member, thereby forming a loop which projects above the plane of the upper surface and is adapted to receive and bind a swimmer's middle finger to the planar member.

U.S. Pat. No. 5,376,036 (Hull) discloses a pull paddle for swim training which includes a paddle having a leading edge and a trailing edge and a longitudinal centerline extending from the leading edge to the trailing edge. The paddle is tapered so that the leading edge is substantially narrower than the trailing edge. The paddle has a relief in the trailing edge defining a wrist detent. The paddle has a center of force no more than 1½ inches from the wrist detent along the longitudinal center line and includes structure for selectively gripping the paddle.

U.S. Pat. No. 9,717,953 (Foss) discloses a swim training paddle for swimmer's hands having: a plate member with a first surface and an opposed second surface and a leading edge and a trailing edge; the opposed first surface and second surface being separated by a leading edge and a trailing edge on opposed ends thereof; the plate member formed to mount to the swimmer's hand with the first surface contacting the players hand; at least two elastic strips forming each forming separate arcs on the first surface and extending out of the second surface; the plate member covering all phalanges and metacarpal bones in swimmers' hands secured to the plate member have an area inset into the plate above the wrist above the ulna so flexing and pronating of the wrist does not allow the trailing edge to be forced into wrist within 2 cm of the ulna.

It has been found that each of the prior art systems can use functional improvements, and working with the original Foss Patent structure as a base provides an excellent starting point for a further optimized hand paddle.

SUMMARY OF THE INVENTION

A swim training apparatus is used on a hand of a swimmer in water during a swimming motion. The training apparatus has: a plate member having a first surface and an opposed second surface and a leading edge and a trailing edge, the opposed first surface and second surface being separated by a leading edge on one end of the plate member, and by a trailing edge on an opposite end thereof; the plate member being formed to mount to the swimmer's hand with the first surface contacting the players hand; at least two elastic strips, each forming separate arcs on the first surface, with ends of the elastic strips extending through the plate member and out of the second surface; the plate member configured to cover all phalanges and metacarpal bones in hands of swimmers secured to the plate member by the two elastic strips and have an area inset into the plate allowing the wrist above the ulna such that flexing and pronating of the wrist while the hand of the swimmer is secured to the hand of the swimmer by the at least two elastic strips without the trailing edge being forced into wrist within 2 cm of the ulna, wherein the first surface has four straight grooves having a bottom and elevated sides along passing from a base of the first surface adjacent the wrist or adjacent the base of the fingers towards a top of the first surface where fingertips extend, wherein height of the elevated sides is at least 1 mm higher than a lowest point of the bottom of the groove.

DETAILED DESCRIPTION OF THE INVENTION

Figure 1:
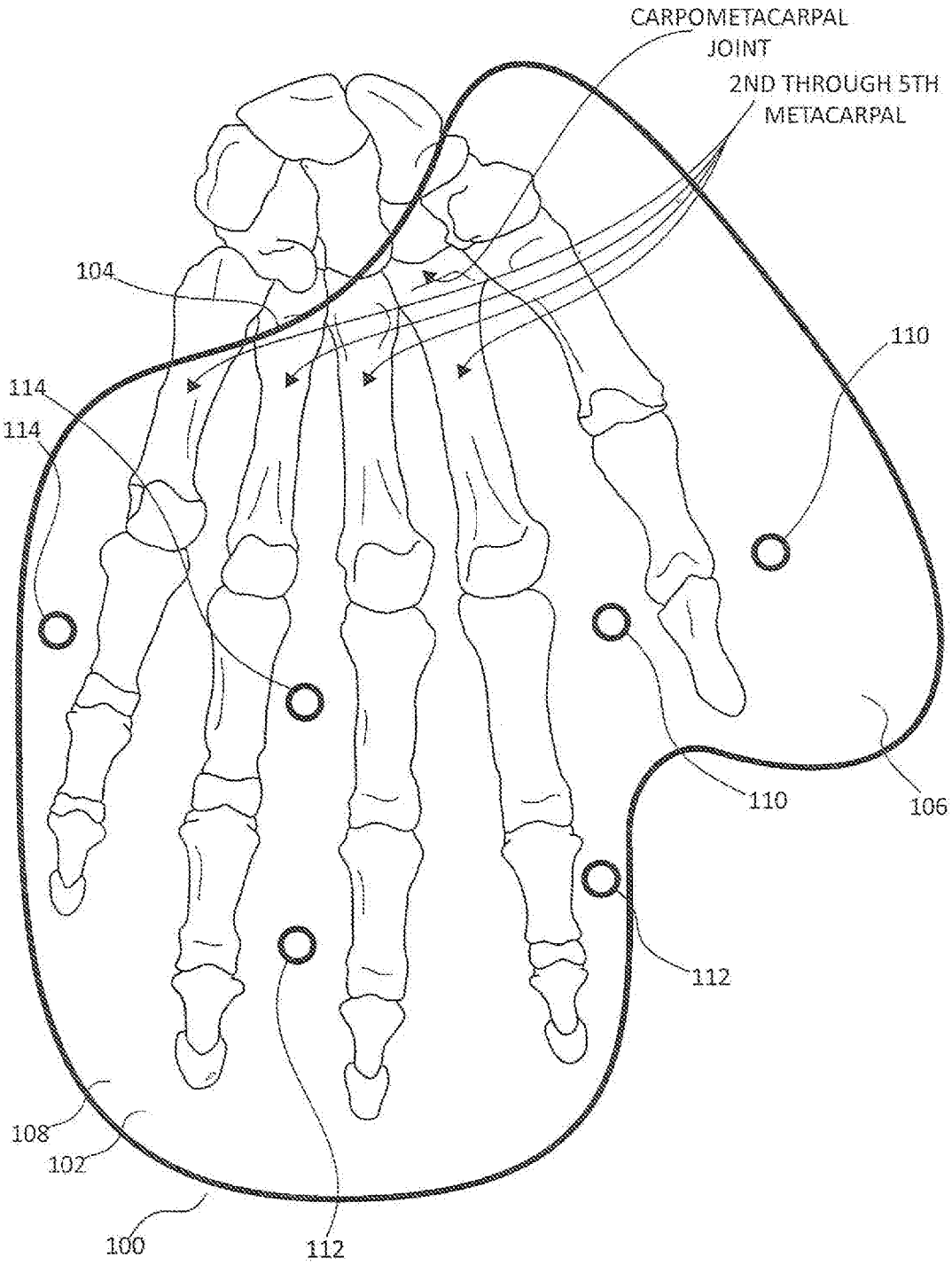
FIG. 1 shows a plate member useful as a paddle superimposed over an image of the bones of a hand.

The present technology includes a swim training apparatus and method of use for use on a hand of a swimmer in water during a swimming motion, said training aid apparatus comprising: a plate member having a first surface and an opposed second surface and a leading edge and a trailing edge, the opposed first surface and second surface being separated by a leading edge on one end of the plate member, and by a trailing edge on an opposite end thereof; said plate member being formed to mount to the swimmer's hand the first surface contacting the players hand; at least two elastic strips forming each forming separate arcs on the first surface, with ends of the elastic strips extending through the plate member and out of the second surface; the plate member configured to cover all phalanges and metacarpal bones in hands of swimmers secured to the plate member by the two elastic strips and have an area inset into the plate allowing the wrist above the ulna such that flexing and pronating of the wrist while the hand of the swimmer is secured to the hand of the swimmer by the at least two elastic strips without the trailing edge being forced into wrist within 2 cm of the ulna, wherein the first surface has four straight grooves having a bottom and elevated sides along passing from a base of the first surface adjacent the wrist towards a top of the first surface where fingertips extend, wherein height of the elevated sides is at least 1 mm higher than a lowest point of the bottom of the groove. The apparatus may be generally flat or have a slight curvature in it to allow fingers to naturally curl forward.

The plate member comprises a polymeric material having a thickness between 1.2 or 1.5 mm and 5 mm, or 1.5 mm to 8 mm. The elastic strips may be rubbery or elastomeric tubing. The elastomeric tubing may be one continuous or two separate pieces of hollow elastomeric tubing of from 1.5 to 6.0 mm or 10.0 mm in outside diameter.

The apparatus may be designed with material selection and properties wherein an absolute force of ten pounds applied by the swimmer's hand secured to the plate member against a bar held flat against the second surface and extending midway under two midpoints of two adjacent metacarpal bones, including a metacarpal bone of the middle finger, will cause a deflection of the leading edge and a contact point of the bar with the plate member under the metacarpal bone of the middle finger is less than 4 cm.

The apparatus may have the plate member constructed of any structural material, some being preferred over others. Even wood (protected against the water), metal and natural materials may be used. However, it is preferred to use a water-insoluble polymer selected from the group consisting of vinyl resins, acrylic resins, polyethylenic or polypropylenic resins, polyurethane resins or silicone resins. The most preferred material for the elastic strips may be a synthetic polymeric elastomer.

Reference to the figures will further assist in an understanding of the present technology.

FIG. 1 shows a plate member 100 useful as a paddle superimposed over an image of the bones of a hand. The plate member 100 has a solid surface 102 with a section 106 of the plate member 102 extending over the thumb and below or over the lesser multiangular bone and the greater multiangular bone. There is also a section 108 that extends over the tips of all of the fingers and all of the metacarpophalangeal joints of the fingers. A recess or indentation 104 in the section 108 at the base of the fingers is shaped to at least extend past the Hamate bone adjacent the pinky finger and the ring finger. The indentation 104 may extend above part of the capitate bone, or may intersect part of that capitate bone. The indentation may overlay the bones of the swimmer's hand so that it intersects the metacarpal bones of at least the 5th and 4th positions, and possibly part of the 3rd position. The relative angle between a center line in the section 106 and a center line in section 108 should be at least 15 degrees, and preferably up to 75 degrees, such as between 30 and 75 degrees pairs of holes 110, 112 and 114 are in the solid surface 102 to receive ties, strings, elastic strips, elastic tubing (not shown) and the like to grasp fingers, pairs of fingers or the thumb during use of the paddles.

Figure 2:
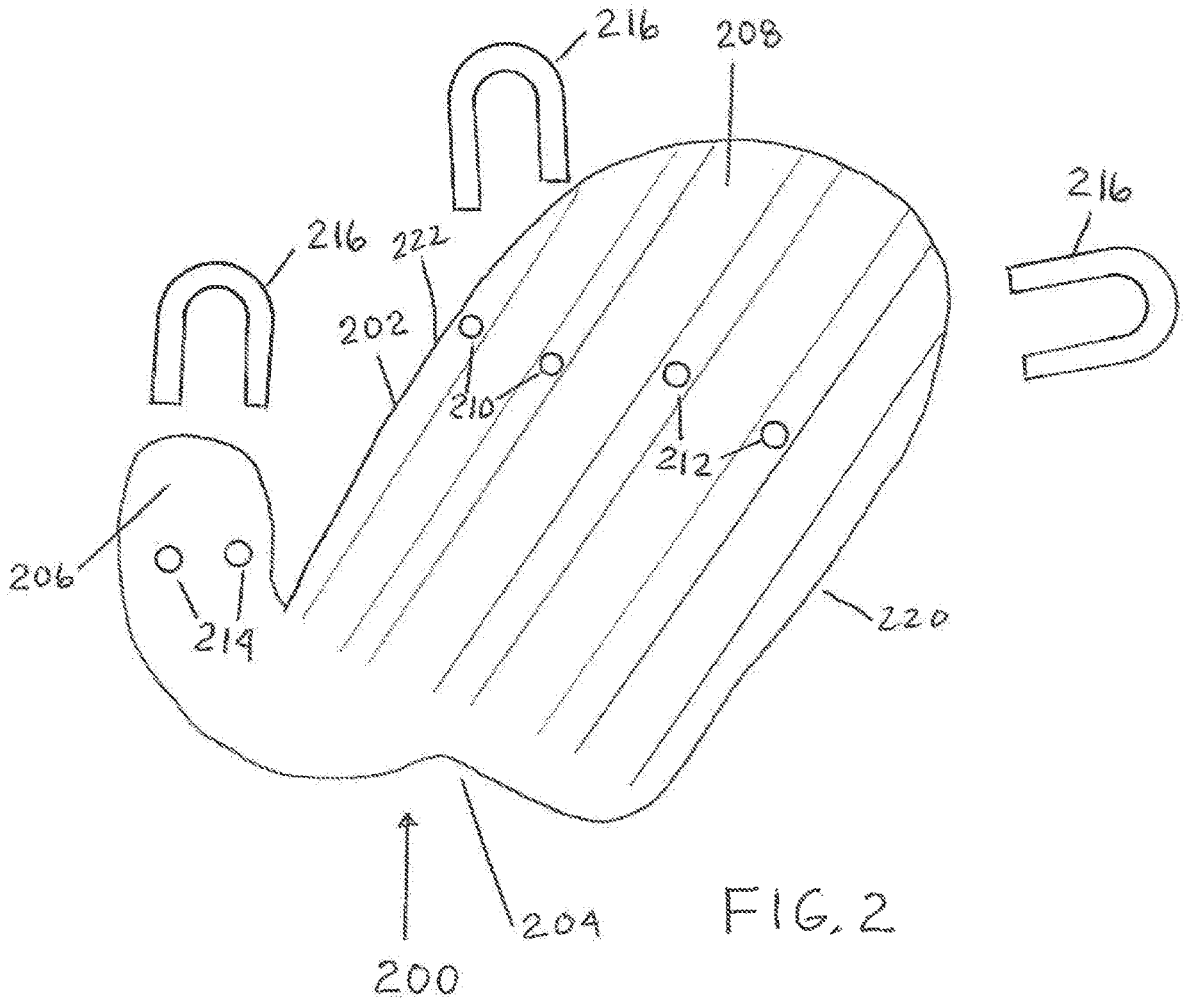
FIG. 2 shows a perspective, exploded view of all elements of the apparatus.

FIG. 2 shows a perspective, exploded view of all elements of the swimmer's hand paddle apparatus 200. The paddle apparatus 200 is shown with a panel 202, indentation 204 above the ulna (not shown), a thumb support region 206 and a hand support region 208. Holes 210 are shown to receive an elastic strip or tubing 216 to grasp the index finger and the middle finger, holes 212 receive an elastic strip or tubing 216 to grasp the ring finger and the pinky finger, and holes 214 receive an elastic strip or tubing 216 to grasp the thumb. The panel 202 is reversible so that it can be used for a right hand or a left hand, by flipping it 180 degrees. It is preferred that the sides 220 and 222 are approximately equal in length. This allows for relatively equal forces to be applied when sliding the paddle both ways side-to-side.

The area inset into the plate may be designed so as to not overlay one or more of the triangular 3*d* y. bone, the lunate bone, the hammate bone and even the capitate bone of the hand while it never intersects or lays over the ulna.

The four straight grooves should have a bottom and there are five elevated sides defining the four straight grooves between them. The two separate arrays of raised bumps are present on the first surface, a first array outside of an elevated side positioned adjacent a groove for a finger adjacent a thumb, and a second array outside of an elevated side positioned adjacent a finger most distal from the thumb.

The four straight grooves have a bottom and there are five elevated sides defining the four straight grooves between them. The two separate arrays of raised bumps are present on the first surface, a first array outside of an elevated side positioned adjacent a groove for a finger adjacent a thumb, and a second array outside of an elevated side positioned adjacent a finger most distal from the thumb. Each raised bump has an elevation of at least 0.5 mm above the first surface. The bottom of each of the four grooves has a friction coating or tack coating to reduce slippage of fingers over the bottom of the four grooves.

Review of the Figures will offer a further appreciation of the invention.

Figure 3:
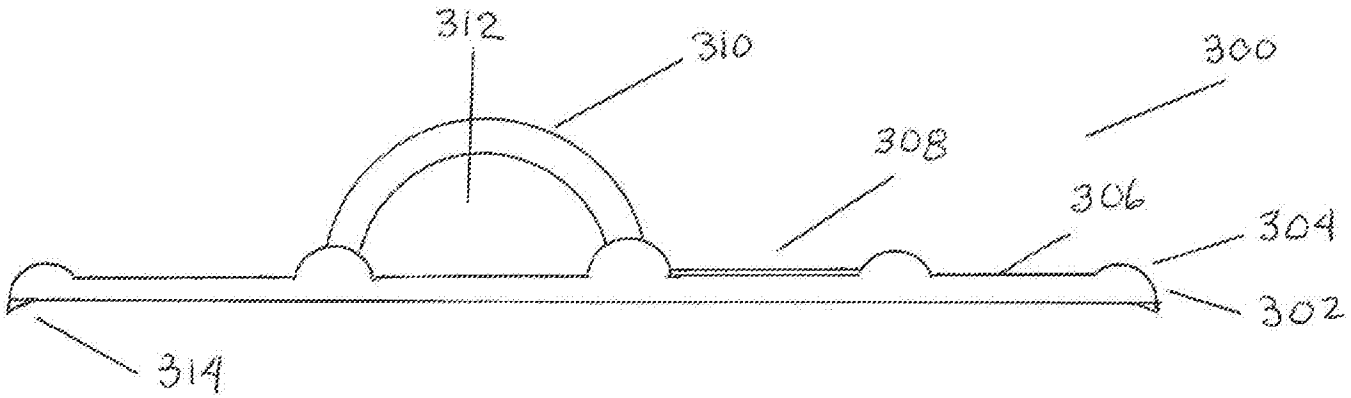
FIG. 3 shows a side view of the finger-only portion of a paddle according to the present technology.

FIG. 3 shows a side view of a front-end look at the finger portion of a paddle 300 of the invention. An end 302 of the paddle 300 is adjacent an elevated side 304 adjacent a first groove 306. Continuing from right to left in FIG. 3 is a coating 308 of a non-slip material (grit-including polymer, rubber, or tack material) over a next groove over the entire first surface. An elastic tube 310 creates a finger supporting cavity 312. There may be slightly forward extensions 314 that can assist in catching water on the edge of the paddle. The second surface may be grooved, flat, textured, and the like. The forward extensions 314 should also be approximately the same length (approximate meaning within ±15%.

Figure 4:
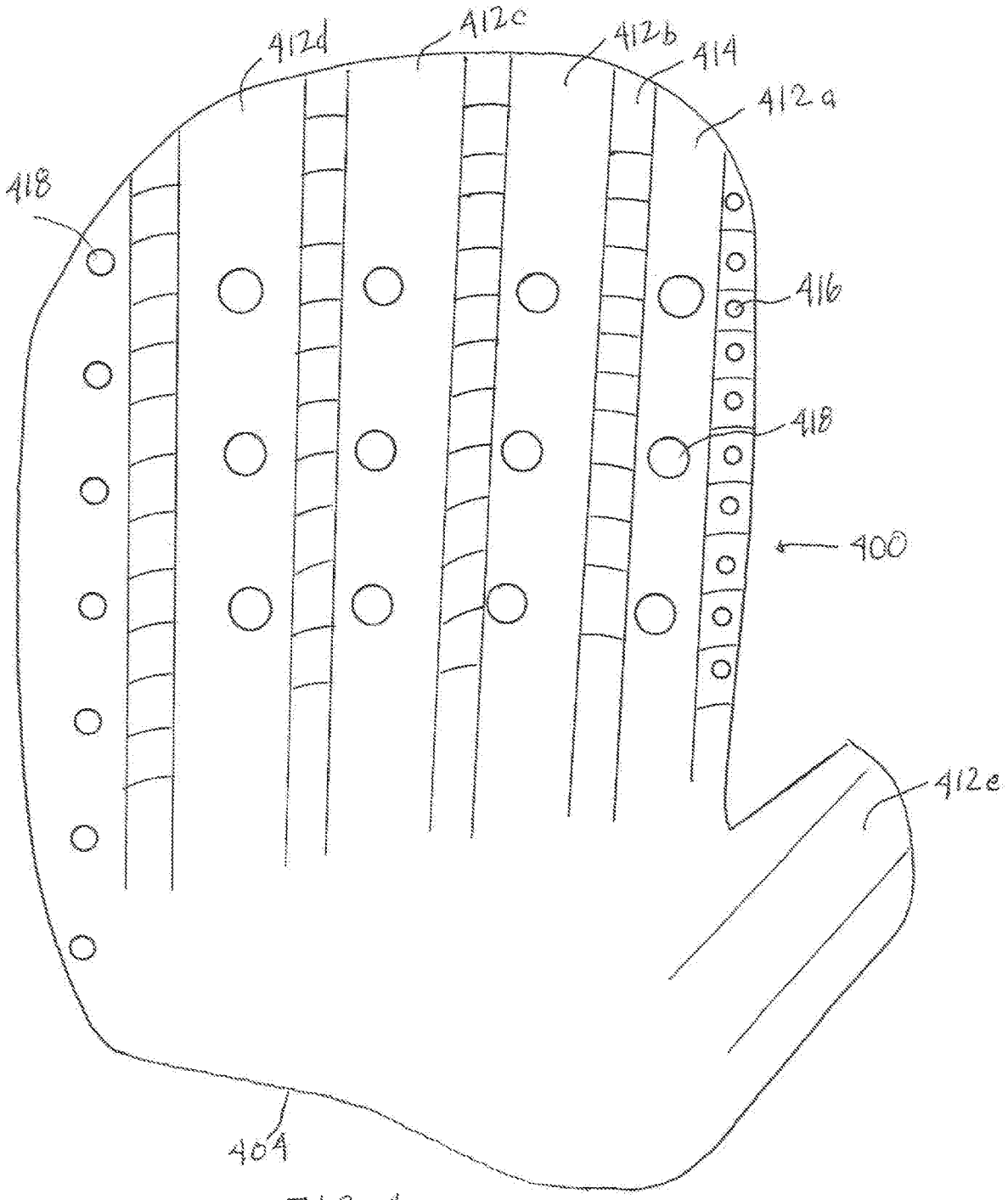
FIG. 4 shows a top view of a paddle according to the present technology.

FIG. 4 shows a top view of a paddle 400 according to the present invention. The paddle 400 has four finger grooves 412*a*, 412*b*, 412*c* and 412*d* separated by ribs, ridges or elevated sides 414. There is fifth groove 412*e* for the thumb. Holes 418 to allow gripping elastic tubes (not shown) are provided in the grooves (412 series) or on the ribs, ridges or elevated sides 414 (not shown). Toward exterior sides of the paddle may be an array of raised bumps 416 to reduce any tendency of swimmers to shift their fingers over edges of the paddle to over-grip the paddles. That action actually reduces the efficiency of the paddle in training hand positioning, pronation and positioning during a proper stroke. The bumps may be the same or different size and spacing on opposed sides of the first surface.

What is claimed:

1. A swim training apparatus for use on a hand of a swimmer in water during a swimming motion, said training aid apparatus comprising: a plate member having a first surface and an opposed second surface and a leading edge and a trailing edge, the opposed first surface and second surface being separated by a leading edge on one end of the plate member, and by a trailing edge on an opposite end thereof; said plate member being formed to mount to the swimmer's hand the first surface contacting the players hand; at least two elastic strips each forming separate arcs on the first surface, with ends of the elastic strips extending through the plate member and out of the second surface; the plate member configured to cover all of the phalanges and at least some of each of the metacarpal bones in hands of swimmers secured to the plate member by the two elastic strips and have an area inset into the plate allowing the wrist above the ulna such that flexing and pronating of the wrist while the hand of the swimmer is secured by the at least two elastic strips without the trailing edge being forced into a wrist of the swimmer within 2 cm of the ulna; wherein an absolute force of ten pounds applied by the swimmer's hand secured to the plate member against a bar held flat against the second surface and extending midway under two mid-points of two adjacent metacarpal bones, including a metacarpal bone of the middle finger, will cause a deflection of the leading edge and a contact point of the bar with the plate member under the metacarpal bone of the middle finger is less than 4 cm, and wherein the first surface has four straight grooves each groove having a bottom and elevated sides along passing from a base of the first surface adjacent the wrist towards a top of the first surface where fingertips extend, wherein height of the elevated sides is at least 1 mm higher than a lowest point of the bottom of the groove.

2. The apparatus of claim 1 wherein the plate member comprises a polymeric material having a thickness between 1.5 and 8 mm.

3. The apparatus of claim 2 wherein the elastic strips comprise elastomeric tubing.

4. The apparatus of claim 3 wherein the elastomeric tubing comprises two separate pieces of hollow elastomeric tubing from 1.5 to 6 mm in outside diameter.

5. The apparatus of claim 1 wherein the plate member comprises a water-insoluble polymer selected from the group consisting of vinyl resins, acrylic resins, polyethylenic or polypropylenic resins, polyurethane resins or silicone resins.

6. The apparatus of claim 2 wherein the plate member comprises a water-insoluble polymer selected from the group consisting of vinyl resins, acrylic resins, polyethylenic or polypropylenic resins, polyurethane resins or silicone resins.

7. The apparatus of claim 5 wherein the elastic strips comprise a synthetic polymeric elastomer.

8. The apparatus of claim 6 wherein the elastic strips comprise a synthetic polymeric elastomer.

9. The apparatus of claim 1 wherein the area inset into the plate does not overlay the hamate bone of a swimmer's hand when secured to the swimmer's hand.

10. The apparatus of claim 1 wherein the area inset into the plate does not overlay the lunate bone of a swimmer's hand when secured to the swimmer's hand.

11. The apparatus of claim 1 wherein the four straight grooves having a bottom and there are five elevated sides defining the four straight grooves between them.

12. The apparatus of claim 11 wherein two separate arrays of raised bumps are present on the first surface, a first array outside of an elevated side positioned adjacent a groove for a finger adjacent a thumb, and a second array outside of an elevated side positioned adjacent a finger most distal from the thumb.

13. The apparatus of claim 4 wherein the four straight grooves having a bottom and there are five elevated sides defining the four straight grooves between them.

14. The apparatus of claim 13 wherein two separate arrays of raised bumps are present on the first surface, a first array outside of an elevated side positioned adjacent a groove for a finger adjacent a thumb, and a second array outside of an elevated side positioned adjacent a finger most distal from the thumb.

15. The apparatus of claim 12 wherein each raised bump has an elevation of at least 0.5 mm above the first surface.

16. The apparatus of claim 14 wherein each raised bump has an elevation of at least 0.5 mm above the first surface.

17. The apparatus of claim 13 wherein the bottom of each of the four grooves has a friction coating or tack coating to reduce slippage of fingers over the bottom of the four grooves.

18. The apparatus of claim 15 wherein the bottom of each of the four grooves has a friction coating or tack coating to reduce slippage of fingers over the bottom of the four grooves.

19. The apparatus of claim 16 wherein the bottom of each of the four grooves has a friction coating or tack coating to reduce slippage of fingers over the bottom of the four grooves.

20. A swim training apparatus for use on a hand of a swimmer in water during a swimming motion, said training aid apparatus comprising: a plate member having a first surface and an opposed second surface and a leading edge and a trailing edge, the opposed first surface and second surface being separated by a leading edge on one end of the plate member, and by a trailing edge on an opposite end thereof; said plate member being formed to mount to the swimmer's hand the first surface contacting the players hand; at least two elastic strips each forming separate arcs on the first surface, with ends of the elastic strips extending through the plate member and out of the second surface; the plate member configured to cover all of the phalanges and at least some of each of the metacarpal bones in hands of swimmers secured to the plate member by the two elastic strips and have an area inset into the plate allowing the wrist above the ulna such that flexing and pronating of the wrist while secured to the hand of the swimmer by the at least two elastic strips without the trailing edge being forced into wrist within 2 cm of the ulna; and wherein the first surface has four straight grooves, each groove having a bottom and elevated sides along passing from a base of the first surface adjacent the wrist towards a top of the first surface where fingertips extend, wherein height of the elevated sides is at least 1 mm higher than a lowest point of the bottom of the groove.

* * * * *